US009103588B2

(12) United States Patent
Williams

(10) Patent No.: US 9,103,588 B2
(45) Date of Patent: Aug. 11, 2015

(54) DRYER FOR GAS MASKS

(71) Applicant: Gary Williams, Langley (CA)

(72) Inventor: Gary Williams, Langley (CA)

(73) Assignee: Williams Boot & Glove Dryers Inc., Langley, BC (CA)

( * ) Notice: Subject to any disclaimer, the term of this patent is extended or adjusted under 35 U.S.C. 154(b) by 457 days.

(21) Appl. No.: 13/738,017

(22) Filed: Jan. 10, 2013

(65) Prior Publication Data

US 2013/0185953 A1 Jul. 25, 2013

Related U.S. Application Data

(60) Provisional application No. 61/588,238, filed on Jan. 19, 2012.

(51) Int. Cl.

| | |
|---|---|
| ***F26B 9/10*** | (2006.01) |
| ***F26B 19/00*** | (2006.01) |
| ***F26B 25/08*** | (2006.01) |
| ***F26B 9/00*** | (2006.01) |
| *F26B 21/00* | (2006.01) |

(52) U.S. Cl.

CPC ..... *F26B 19/00* (2013.01); *F26B 9/003* (2013.01); *F26B 9/10* (2013.01); *F26B 25/08* (2013.01); *F26B 21/006* (2013.01)

(58) Field of Classification Search

CPC ..... F26B 9/003; F26B 19/00; F26B 19/005; F26B 21/001; F26B 21/006; F26B 21/008

See application file for complete search history.

(56) References Cited

U.S. PATENT DOCUMENTS

| | | | | |
|---|---|---|---|---|
| 6,553,687 | B1 * | 4/2003 | Leamon, Jr. | 34/104 |
| 8,024,870 | B1 * | 9/2011 | Ballentine et al. | 34/104 |
| 8,595,951 | B2 * | 12/2013 | Peet | 34/105 |
| 8,984,766 | B2 * | 3/2015 | Williams | 34/381 |
| 2004/0068888 | A1 | 4/2004 | Lurie | |
| 2007/0261263 | A1 * | 11/2007 | Lee | 34/201 |
| 2012/0324752 | A1 * | 12/2012 | Jon | 34/106 |
| 2013/0191975 | A1 * | 8/2013 | Wirthenstatter | 2/423 |
| 2014/0013609 | A1 * | 1/2014 | Kilgore et al. | 34/89 |

FOREIGN PATENT DOCUMENTS

EP 2 286 712 A2 2/2011

OTHER PUBLICATIONS

Haegman, Marc, European Search Report for Application No. EP 13 15 1856, The Hague, Date of Completion of Search Feb. 13, 2014, 5 pages.

* cited by examiner

*Primary Examiner* — David J Laux

(74) *Attorney, Agent, or Firm* — Fay Sharpe LLP

(57) ABSTRACT

A forced air dryer for gas masks or other face pieces having a drinking tube attached. A housing having a blower is attached to a distribution manifold with a heater therein. Spaced riser tubes each with spaced tubular mask support arms attached thereto are releasably fastened to the manifold for receiving forced air therein. In one version, adapted for wall mounting, the riser tubes extend vertically downward from the manifold; and, in another free standing version, the riser tubes extend vertically upward from the manifold. Each support arm has a wire support frame or "basket" thereon configured to support a gas mask or face piece with attached drinking tube thereon with a nozzle discharging forced air upwardly through the wire frame to the interior of the gas mask. Each riser has a separate air discharge nipple proximate each support arm and configured for threaded engagement with a canteen cap connected to the drinking tube for concurrently forcing air through the drinking tube. The dryer may be shipped disassembled in kit form, for ready reassembly, in situ, by the user.

16 Claims, 10 Drawing Sheets

DRYER FOR GAS MASKS

The present application claims priority from U.S. Provisional Patent Application No. 61/588,238, filed Jan. 19, 2012, by Gary Williams and is entitled "Dryer for Gas Masks" and is incorporated herein by reference in its entirety.

BACKGROUND

The present disclosure relates to apparatus for drying a plurality of gas masks, after use for practice or in actual emergency, where the mask is intended for reuse. Present gas masks, particularly those for use in the field by military personnel, paramilitary and first responders such as police and fire fighters, have provided thereon a drinking tube which extends outwardly through a seal in the mask and is connected to a canteen carried by the mask user. Typically, in military gas mask and canteen arrangements, the drinking tube from the mask attaches to a nipple provided on the canteen filler cap.

Where gas masks are removed by the user and allowed to simply air dry, it has been found that the drinking tube attached to the canteen retains moisture therein and is subject to contamination by growth of bacteria and/or mold resulting in an unsanitary and medically hazardous condition of the tube on reuse by the user. Accordingly, it has been desired to provide a convenient and economical way or means of preventing formation of mold in the drinking tube of the gas mask and for concurrently drying the mask to prevent mold from forming therein where the mask is intended for reuse.

BRIEF DESCRIPTION

The present disclosure provides a drying apparatus for ambient temperature or warm air drying a plurality of gas masks or other face piece such as a respirator and the associated drinking tube provided with the mask or face piece for attachment to a canteen. The dryer of the present disclosure has a blower housing with a blower therein which selectively discharges ambient air to an attached manifold with a heater. In one version, adapted for wall mounting, the manifold has a plurality of downwardly extending riser tubes releasably attached thereto with each of the riser tubes having a plurality of arms extending therefrom with each arm having an air nozzle provided thereon. In another free standing version, the releasably attached riser tubes extend vertically upward from the manifold. The blower forces air at ambient temperature air into the manifold with the heater which discharges either ambient or heated air through openings therein into the riser tubes and through apertures in the riser tubes into the arms extending from the riser tubes and outwardly through the orifices or nozzles for drying the interior of the gas mask or face piece placed on each of the arms. The arms include a wire frame rack or "basket" which supports the shape of the gas mask over the nozzle to insure that the flow of forced air from the nozzle, whether ambient temperature or heated, completely dries the interior of the gas mask. A separate discharge nipple is provided on the riser proximate each of the arms which nipple is configured for ready attachment thereto of a canteen filler cap to which a drinking tube from the mask is attached so that the gas mask and drinking tube are concurrently dried. Forced ambient or heated air from the riser is discharged through the nipple and canteen cap to the drinking tube to positively dry the drinking tube and mask concurrently through the support arm nozzles to the gas masks to prevent formation of mold and bacteria therein.

The dryer may be shipped in kit form with the blower housing and attached manifold with heater as a subassembly and, if desired, packaged separately. The kit may be arranged to have the riser tubes with support arms packaged separately. Upon arrival at a site at which the masks are to be dried, the risers may then be readily assembled to the manifold subassembly with threaded fasteners, the mounting brackets installed and the complete dryer assembly wall mounted in preparation for hanging the gas masks thereon for drying. If shipped disassembled, the wire support frames or baskets may then be installed on the support arms.

DETAILED DESCRIPTION

Figure 1:
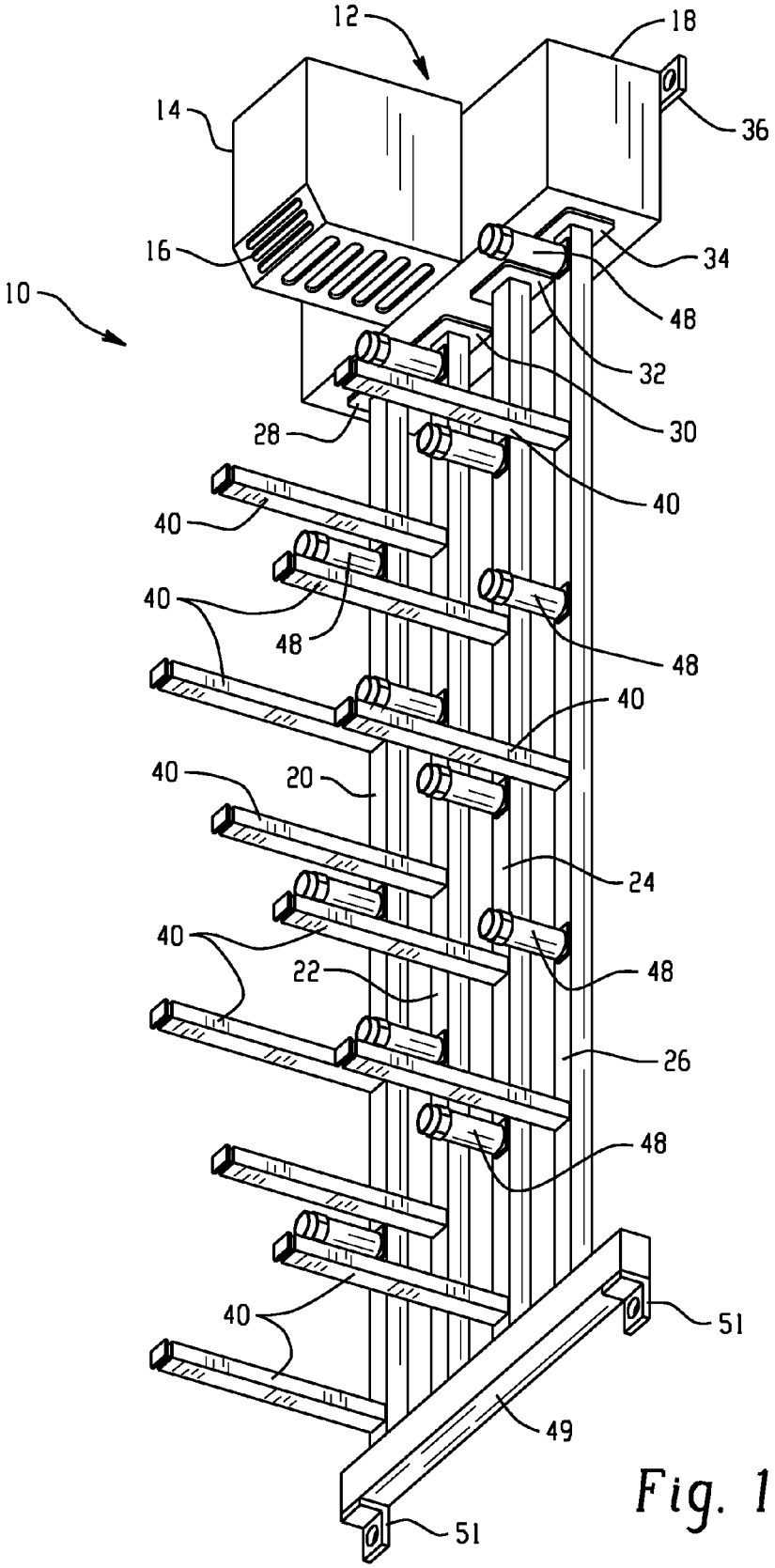
FIG. 1 is a perspective view of the assembled dryer of the present disclosure.

Referring to FIG. 1, the assembled dryer is indicated generally at 10 and has a subassembly indicated generally at 12 which comprises a blower housing 14 which has provided therein a blower with air intake slots 16 with may be louvered. The blower housing 12 shown attached to a manifold 18 with an unshown heater therein has an outlet which may comprise plural orifices (not shown) and discharges through the outlet to inlet orifices (not shown) into the interior of the manifold 18 at the attachment thereof. In the illustrated version, the blower housing 14 is attached to the frontal wall or face of the manifold 18; however, alternatively, the blower housing may be attached to the top or upper surface of the manifold 18. The blower housing may be permanently attached to the manifold as a subassembly or alternatively releasably attached with fasteners such as screws (not shown). The manifold has attached thereto the plurality of vertically downward extending riser tubes 20, 22, 24, 26; and, each of the tubes has a flange respectively 28, 30, 32, 34 attached to the upper end thereof, as, for example, by weldment. Each of the flanges 28, 30, 32, 34 is attached to the underside of the manifold 18 releasably or removably, such as, by threaded fasteners received through attachment holes provided in the flange and denoted typically by reference numeral 35 (see FIG. 8). The manifold has attachment brackets on each side such as bracket 36 provided thereon for attachment to a support structure such as a wall.

Figure 7:
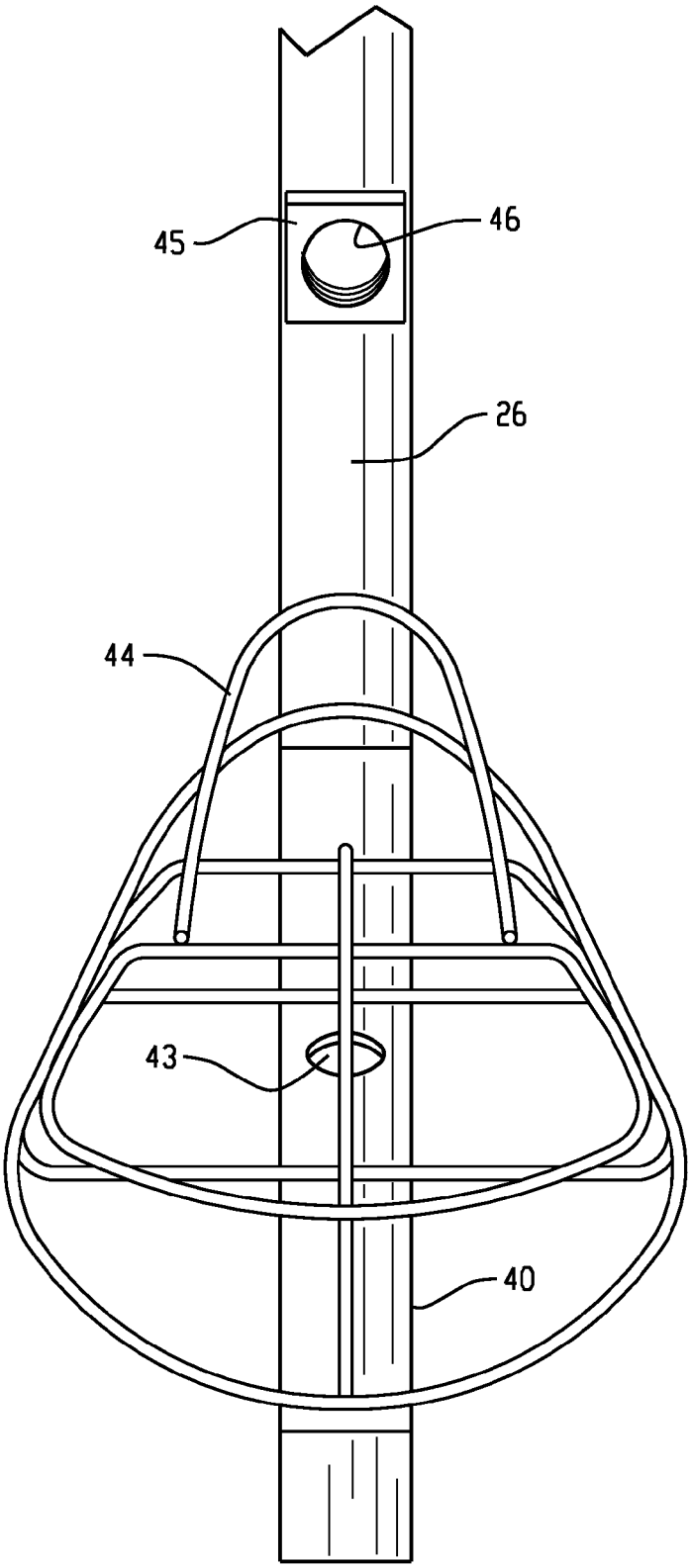
FIG. 7 is a perspective view of one of the mask support arms with the wire basket in place and shows the air discharge port or nipple on the support arm and the threaded opening for one of the canteen cap nipples on the riser.

Each of the riser tubes 20, 22, 24, 26 has provided thereon a plurality of spaced tubular support arms denoted typically at 40 and spaced longitudinally therealong. Each of the support arms 40 extends generally horizontally in cantilever from its respective riser tube and is attached thereto such as by weldment. The interior of the tubular support arm communicates through an aperture (not shown) in the riser tube. Air in the manifold discharges through unshown holes in the bottom of the manifold, into the hollow interior, denoted by reference numeral 42 in FIG. 8, of the riser tube; and, air within each of the riser tubes 20, 22, 24, 26 is supplied to the interior of each of the arms 40. Each of the arms 40 has provided on the upper surface thereof, at a position intermediate the ends of the arm, an air discharge orifice or nozzle, typically denoted 43 (see FIG. 7) for providing air to the interior of a gas mask or face piece disposed thereon as will hereinafter be described.

Figure 2:
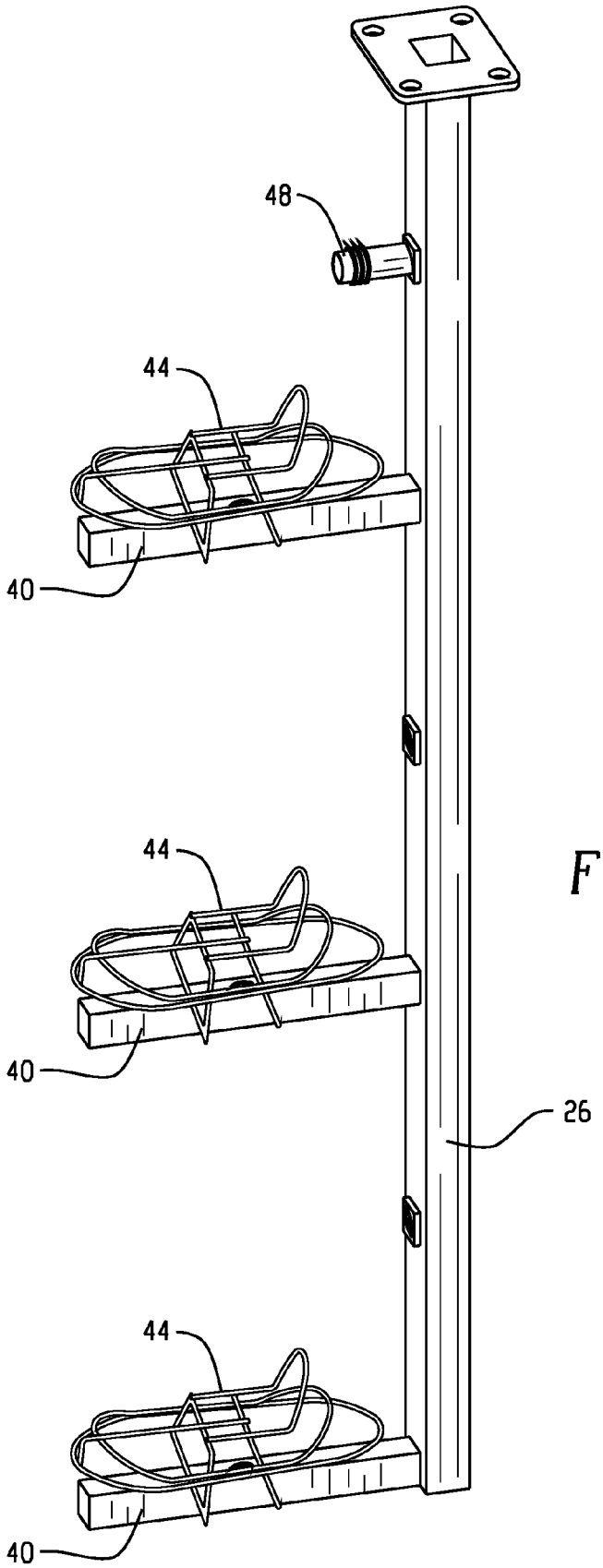
FIG. 2 is a pictorial view of one of the risers of the dryer of FIG. 1 detached from the manifold.
Figure 3:
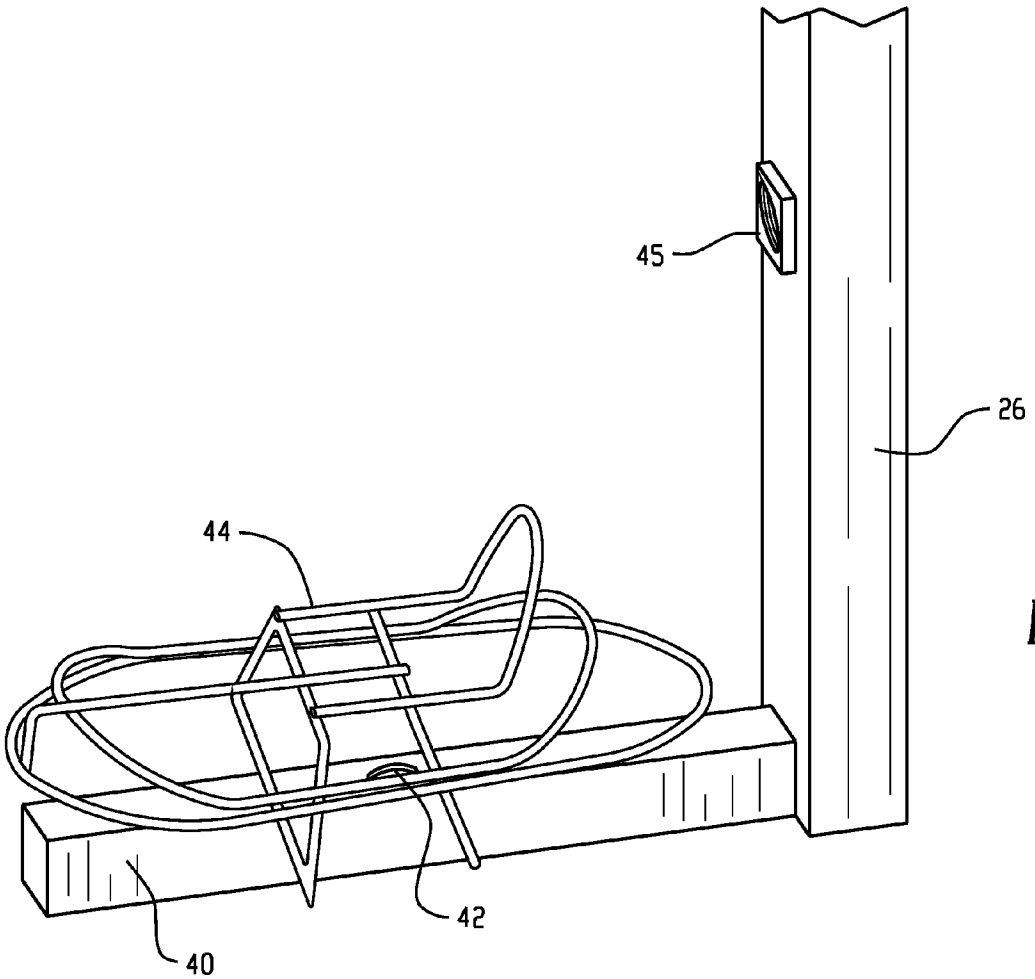
FIG. 3 is a perspective view of one of the riser arms with the wire form attached.
Figure 4:
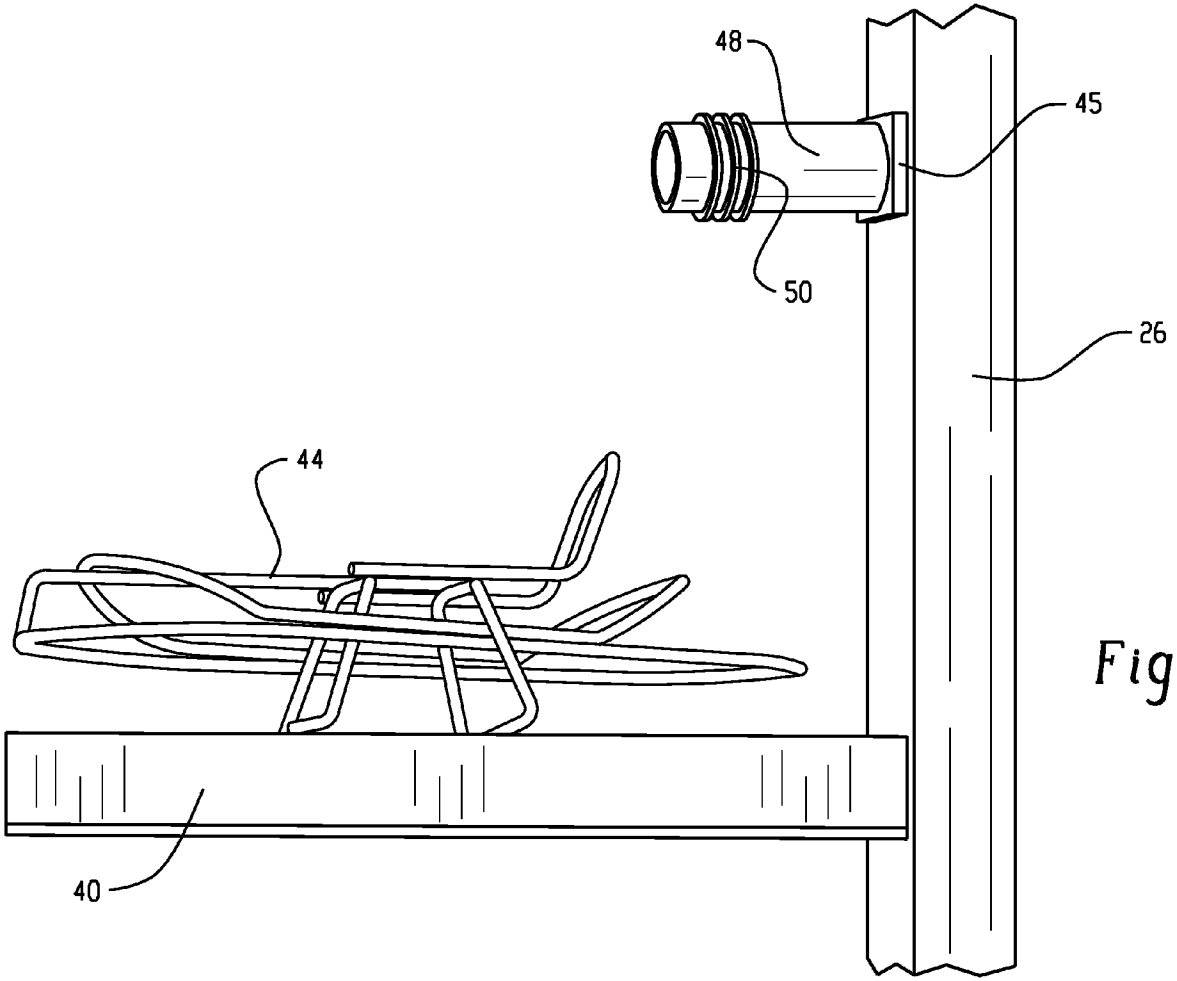
FIG. 4 is a view similar to FIG. 3 showing the arm extending from the riser and the nipple for attachment of the canteen cap.

Referring to FIG. 2, one of the riser tubes 26 is shown, it being understood that the illustration is typical also of riser tubes 20, 22, 24. The riser tube 26 is illustrated with the attached arms 40 each as having a wire support frame or "basket", indicated typically at 44, which is configured to conform to the interior of a gas mask or face piece. The wire frames 44 are positioned over the respective discharge orifice 42 as shown typically in FIG. 7. The wire support frame or "basket", thus, provides for positioning and locating the gas mask or face piece over the discharge orifice 42 so that air discharging through the nozzle properly dries the interior of the mask. The support frames 44 may be permanently attached to the support arm 40 or releasably attached by clamps and screws (not shown) threadedly engaging internally threaded holes in the arm 40.

In the present practice, it has been found satisfactory to form the riser tubes 20, 22, 24, 26 of square metal tubing having a side about 35 mm in width and about 1.2 meters in length. The lower ends of the risers 20, 22, 24, 26 are interconnected by a cross member 49 which in one version may have wall mounting brackets 51 provided thereon. In the present practice, it has been found satisfactory to form the riser tubes and the support arms of corrosion resistant metal and having a rectangular or square shape in transverse section.

Referring to FIGS. 1, 2, 4, 7 and 8, each of the risers has provided thereon openings, denoted typically at 46, each spaced adjacent and in proximity to an arm 40, the openings 46 having threads provided therein into which may be threadedly engaged an externally threaded end (not shown) of a nipple 48 which may be formed of suitable plastic. In the illustrated version, each of the threaded openings 46 is formed in a nut plate 45 welded to the tubular riser. Each of the nipples 48 may be provided thereon a standard thread for a canteen cap such as the threads suitable for a standard NATO military canteen cap which threads are indicated by reference numeral 50 in FIG. 4. In the present practice, it has been found satisfactory to form the nipples 48 of plastic material, such as, for example, polyoxymethylene (POM) material.

Figure 5:
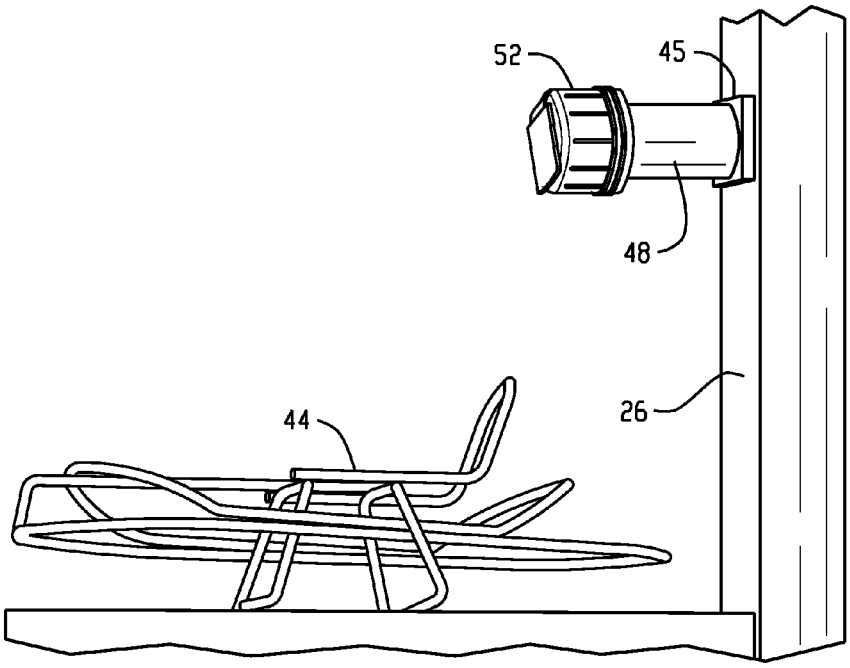
FIG. 5 is a view similar to FIG. 4 with a cover cap attached to the nipple.
Figure 6:
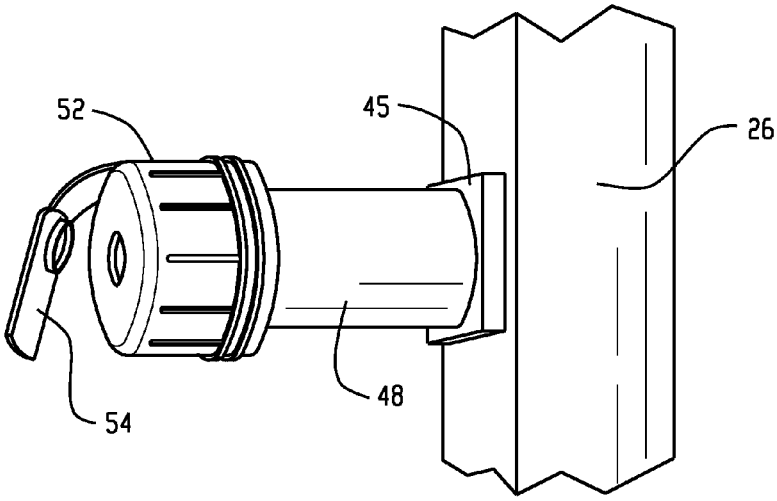
FIG. 6 is an enlarged view of the canteen cap of FIG. 5.
Figure 8:
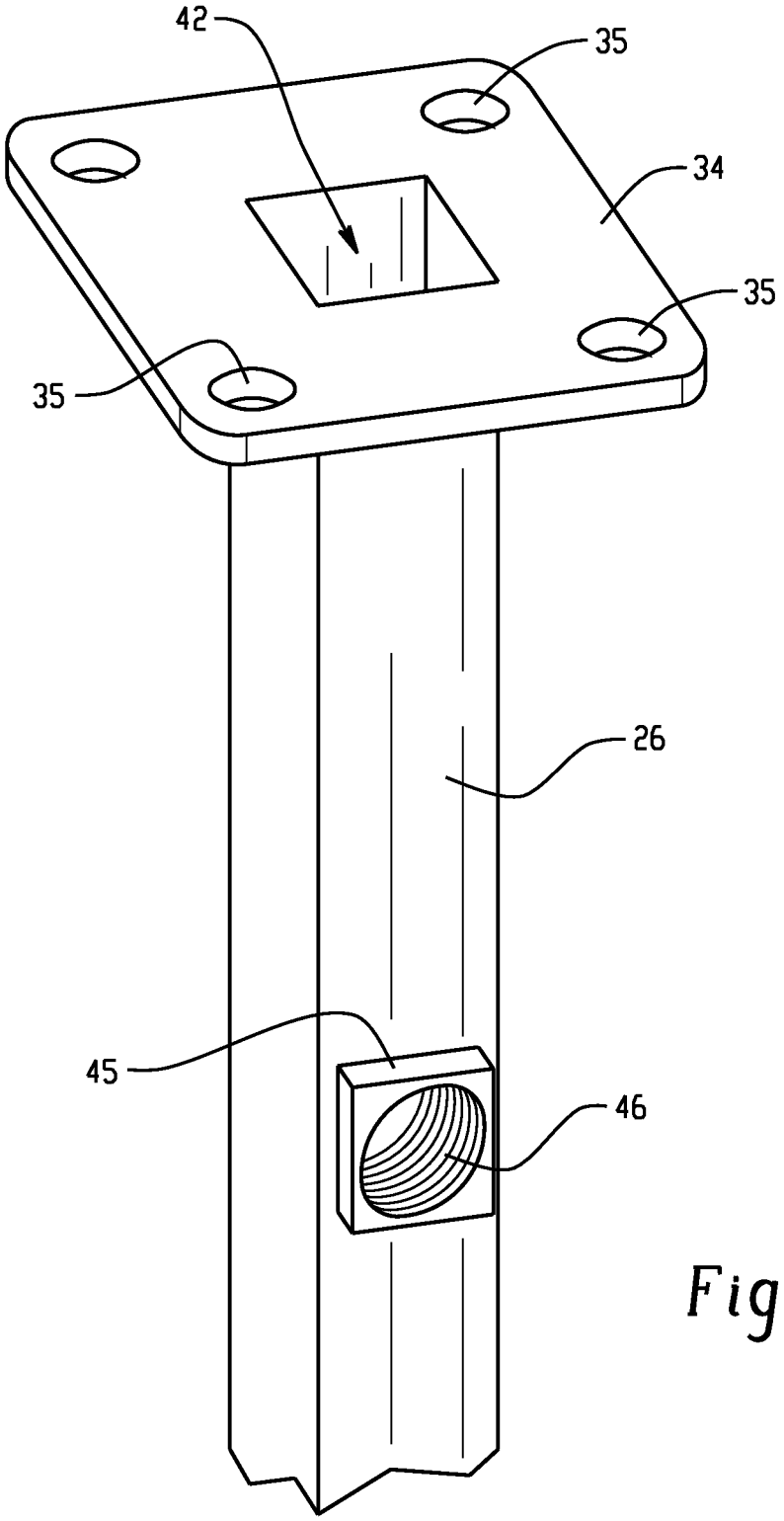
FIG. 8 is a close up view of the removable flange for one of the risers and shows the threaded opening for the canteen cap nipple in greater detail.
Figure 9:
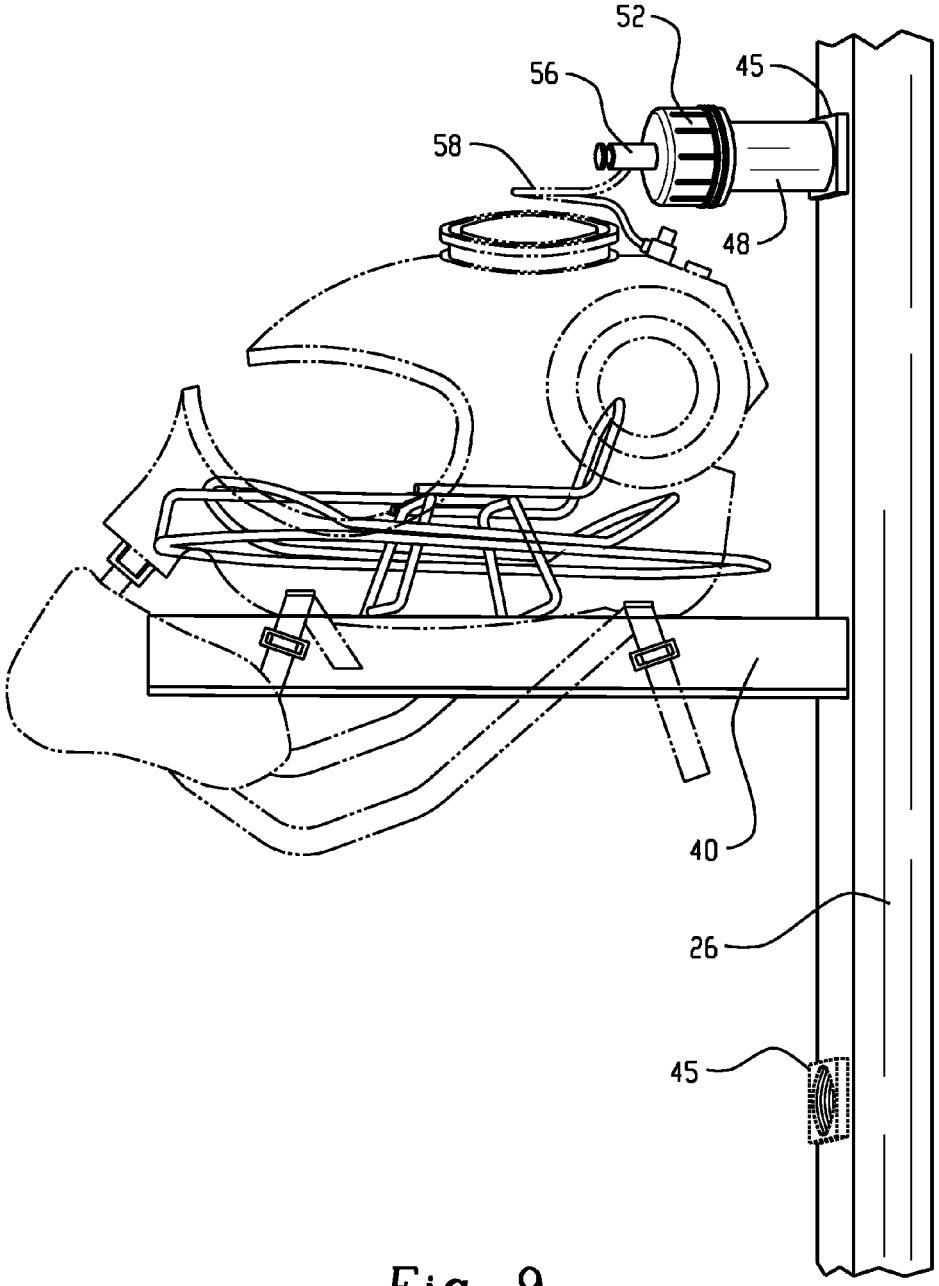
FIG. 9 is a side view of one of the support arms on the riser with the gas mask in place and shows the canteen cap attached to the adjacent nipple with the drinking tube connected between the canteen cap and the gas mask.
Figure 10:
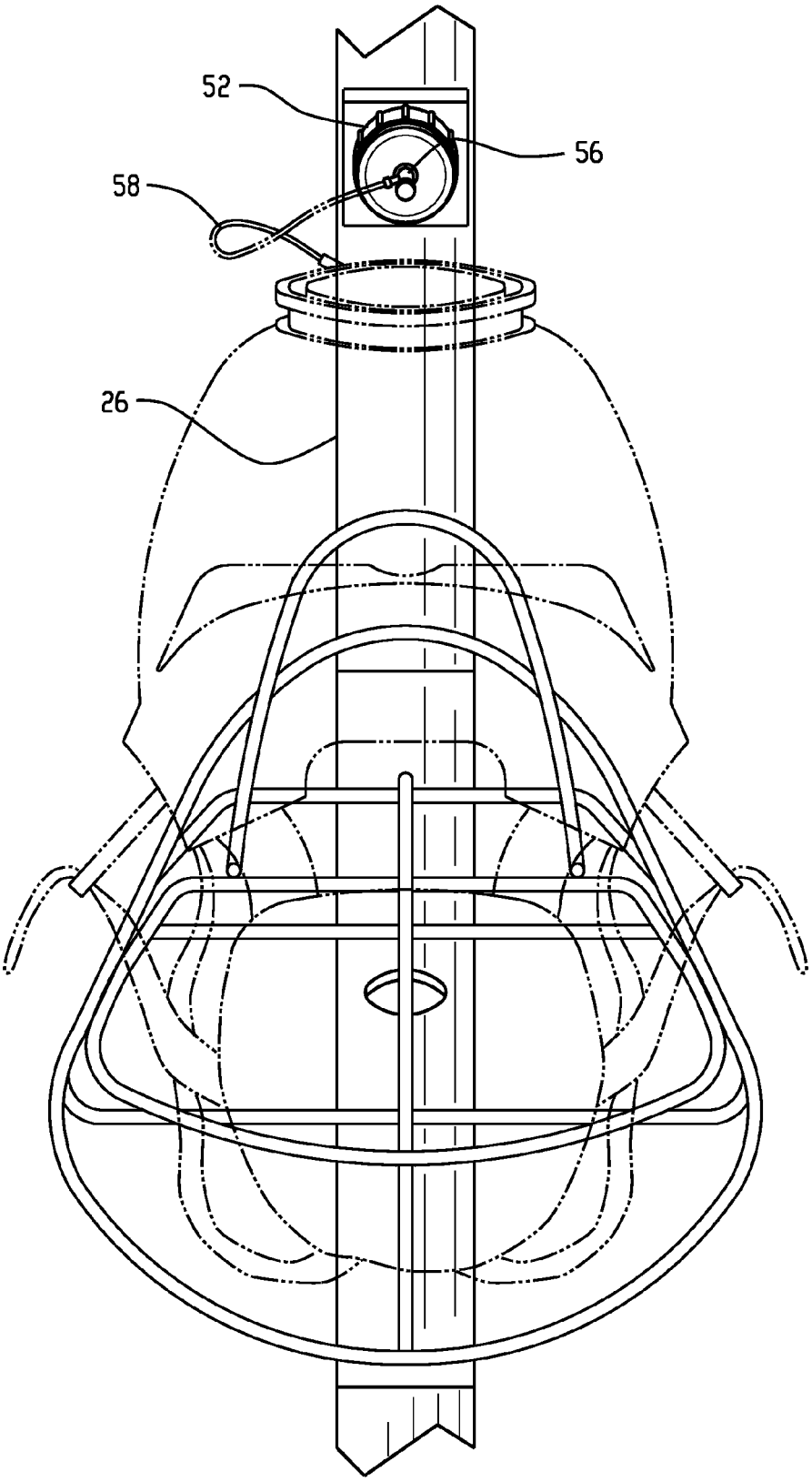
FIG. 10 is a front view of the arrangement of FIG. 9.

Referring to FIGS. 5 and 6, typical NATO canteen cap 52 is shown threadedly engaged over the threads 50 on an end of one of the nipples 48. In FIG. 6, a covering flap 54 is shown open on the canteen cap to permit attachment of a fitting 56 (see FIG. 9) for engagement of a drinking tube 58 which is also connected to the gas mask as shown in FIGS. 8 and 9.

Figure 11:
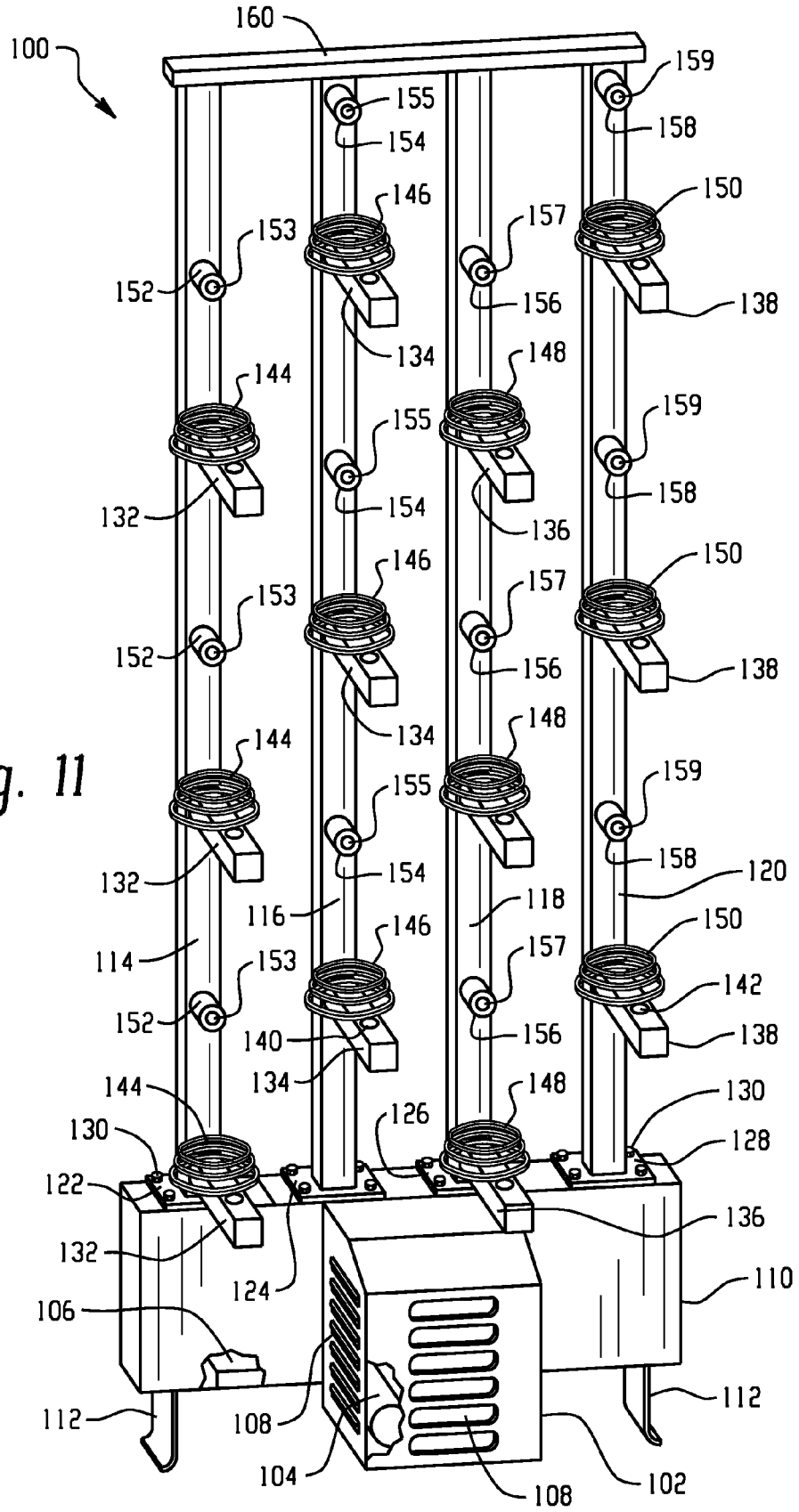
FIG. 11 is a perspective view of another, free standing, version of the dryer of the present disclosure.

Referring to FIG. 11, another version of the dryer of the present disclosure is illustrated an indicated generally at 100 and has a blower housing 102 with a blower 104 contained therein which may be selectively energized by remote control. The blower housing includes louvered air inlets 108 for providing supply air to the blower 104. The blower housing 102 is attached to the front face of a distribution manifold 110 with a heater 106 therein selectively energizable. It will be understood that the front face of the manifold 110 has an unshown opening therein, or a plurality of openings, for permitting discharge air from the blower to enter the interior of the manifold. The manifold has attached to the opposite ends thereof support brackets 112 extending downwardly therefrom for supporting the manifold on the surface on which the dryer rests. If desired, the brackets 112 may be releasably attached to the under surface of the manifold as, for example, by suitable threaded fasteners.

The upper surface of the manifold has releasably attached thereto a plurality of spaced riser tubes 114, 116, 118, 120 each of which tubes has attached thereto at the lower end thereof a mounting flange 122, 124, 126, 128, respectively. Each of the mounting flanges has a plurality of apertures provided therein, although not shown in FIG. 11, which may be similar to the apertures 35 of the version shown in FIG. 8. The flanges are typically welded to the ends of the riser tubes 114, 116, 118, 120 and the flanges are releasably attached to the upper surface of the manifold by suitable fasteners such as bolts 130 engaging internally threaded surfaces. The internally threaded surfaces may be provided in the upper face of the manifold, such as, for example, by welded nuts provided on the undersurface of the top of the manifold.

Each of the tubular risers 114, 116, 118, 120 has provided thereon a plurality of spaced tubular support arms 132, 134, 136, 138 which are attached at an end thereof respectively to the risers such as by weldment. The attached ends of the support arms each communicate with the interior of the riser tube to which is connected by a suitable aperture (not shown in FIG. 11). It will be understood that the free end of each of the support arms 132, 134, 136, 138 is closed. Each of the support arms 132, 134, 136, 138 has an aperture provided on the upper surface thereof as shown in FIG. 11 and denoted by reference numerals 140, 142 with respect to the support arms 134, 138.

Each of the supports arms 132, 134, 136, 138 has provided thereon a support frame 144, 146, 148, 150, respectively, which may comprise a wire frame or "basket" configured for contacting and supporting in shape the interior of a gas mask or face piece with drinking tube. Each of the risers 114, 116, 118, 120 has provided thereon a plurality of spaced pair of discharge nipples denoted, respectively, 152, 154, 156, 158, each of which is proximate one of the supports arms respectively 132, 134, 136, 138. Each of the nipples 152, 154, 156, 158 has an air discharge orifice such as orifice 153, 155, 157, 159 provided in the free end thereof and also has surfaces thereon as, for example, suitable external threads at the free end, for receiving thereon a canteen cap. The nipples 152, 154, 156, 158 may have a configuration similar to the nipple 48 shown in the version of FIG. 4. If desired, the nipples 152, 154, 156, 158 may be provided with additional threads (not shown) at the end distal the free end which threads may engage suitable internal threads (not shown) in each of the riser tubes 114, 116, 118, 120, respectively, similar to the arrangement shown in FIG. 8. It will be understood that the support frames/baskets 144, 146, 148, 150 may be permanently attached to the support arms or, alternatively, may be secured thereto by suitable clamps (not shown) attached to the support arms by a convenient expedient such as screws.

The upper ends of the risers 114, 116, 118, 120 are interconnected by a suitable cross piece 160 which may be secured thereto by lugs (not shown) extending into the interior of the tubes in a manner providing releasable assembly thereof. The dryer 100 may be conveniently shipped in disassembled form with the lower housing 102 and manifold 110 forming a subassembly and the risers packaged separately therefrom with the nipples, gas mask or face piece supporting baskets and cross piece 160 detached therefrom. This provides for convenient and minimal volume and reduced cost packaging for shipping. When shipped in kit form, the user attaches the flanges 122, 124, 126, 128 to the manifold with the fasteners 130 provided in the kit and installs the cross piece 160 and assemblies the baskets and nipples to the risers and support frames, in situ, with a minimum of tools required. The version 100 of FIG. 11 thus provides a free standing dryer which is self-supporting on the surface upon which it rests and thus may be moved about as opposed to fixed mounting on a wall as is the arrangement for version 10 of FIGS. 1-10.

The present disclosure thus describes a unique dryer for drying concurrently a gas mask or other face piece having a drinking tube provided therewith for attachment to a canteen carried by the user. The dryer of the present disclosure has a subassembly of a housing having a blower and manifold with heater therein which may have releasably or removably attached thereto a plurality of spaced tubular risers which receive forced air from the manifold directed interiorly of the tubes and into the spaced tubular arms on the riser tubes for discharge through nozzles on the arms.

Each of the support arms extending from one of the riser tubes has provided thereon a discharge port for discharging air upwardly through a support frame or "basket" which may be formed of wire located along the arm to position the gas mask or face piece correctly for drying the interior thereof. Separate air discharge nipples are provided on the risers proximate the support arms and configured with attachment surfaces thereon, such as threads for receiving thereon a standard threaded canteen cap. The cap from the canteen may be attached to one end of the drinking tube provided with the gas mask or face piece and the cap engaged onto the nipple for concurrent drying of the drinking tube with the gas mask. Alternatively, the nipple may be configured to attach directly to a drinking tube, which may, for example, have a quick-disconnect fitting for attachment to the canteen cap; and, thus the canteen cap omitted for connection of the tube to the dryer. The dryer of the present disclosure thus, enables users to dry a plurality of gas masks or face pieces and their associated drinking tubes in a manner which prevents formation of mold due to residual moisture and bacteria in the gas mask face piece and drinking tube.

Although the dryer is illustrated here in the assembled condition, it may be shipped disassembled as a kit. In the kit, the subassembly of blower housing and manifold may be packaged separately. The riser tubes with support arms packaged separately may be user assembled in situ to the manifold. The mounting brackets may also be assembled, in situ, to the manifold and the cross piece assembled over the end of the riser tubes distal the manifold. The wire frames may be packaged separately and assembled, in situ, to the support arms. If desired in kit form, the nipples 48 may be packaged disassembled separately from the risers and threadedly assembled to the riser, in situ, by the user. The ability to be shipped as a disassembled kit which can easily be assembled by the user on site with a few threaded fasteners renders the dryer of the present disclosure quite desirable and economical with regard to handling and shipping.

The exemplary version has been described with reference to the drawings. Obviously, modifications and alterations will occur to others upon reading and understanding the preceding detailed description. It is intended that the exemplary version be construed as including all such modifications and alterations insofar as they come within the scope of the appended claims or the equivalents thereof.

The invention claimed is:

1. A method of making a forced air dryer for gas masks having a drinking tube comprising:

(a) disposing a blower housing on a manifold and supplying forced air from the blower housing to the manifold;

(b) releasably connecting an end of a plurality of riser tubes to the manifold and directing forced air from the manifold into the riser tubes;

(c) connecting a plurality of tubular cantilever support arms to each of the plurality of riser tubes and supplying forced air from the riser tubes into each of the support arms;

(d) forming an air discharge aperture on an upper surface of each support arm; and, (e) disposing an air discharge nipple on the risers proximate each support arm and configuring certain surfaces of the nipple for attachment of a canteen cap with drinking tube.

2. The method of claim 1, further comprising disposing a support frame configured to fit the interior of the gas mask on each supporting arm over the air discharge aperture.

3. A kit for user assembly, in situ, of a forced air dryer for gas masks with a drinking tube comprising:

(a) a subassembly including a housing with a blower and a manifold attached thereto for receiving forced air from the blower housing;

(b) a plurality of riser tubes each having an attachment flange proximate an end thereof with certain surfaces thereof configured for releasable attachment to the manifold, each of the plurality of riser tubes having a tubular support arm attached thereto, each support arm having a discharge orifice; and, a plurality of air discharge nipples for assembly onto the riser tubes for attachment of a canteen cap and drinking tube;

(c) a cross piece for user assembly over the end of the riser tubes distal the manifold; and, (d) a plurality of fasteners for enabling user attachment of the riser flanges to the manifold.

4. A forced air dryer for gas masks having an attached drinking tube comprising:

(a) a blower housing including a blower and an attached manifold;

(b) a plurality of spaced riser tubes each releasably attached at an end thereof to the manifold, and operative to receive therein forced air discharged from the manifold, each of the riser tubes having a plurality of spaced support arms extending therefrom, each arm having a discharge orifice thereon wherein the riser tube has orifices thereon operative for supplying forced air to the support arms;

(c) a support frame/basket disposed on each arm and located thereon to receive forced air from the discharge orifice, the support basket configured to support thereon a gas mask having an attached drinking tube;

(d) a nipple disposed on each riser tube proximate each support arm and operative to receive forced air from the riser on which the nipple is disposed and having surfaces thereon configured for connection to a canteen cap for supplying forced air to the drinking tube when attached to the canteen cap; and, (e) a cross piece connected to the ends of the riser tubes distal the manifold.

5. A forced air dryer for a face piece having an attached drinking tube comprising:

(a) a blower housing including a blower and an attached manifold;

(b) a plurality of spaced riser tubes each releasably attached at an end thereof to the manifold, and operative to receive therein forced air discharged from the manifold, each of the riser tubes having a plurality of spaced support arms extending therefrom, each arm having a discharge orifice thereon, wherein each of the riser tubes has orifices thereon operative for supplying forced air to the support arms;

(c) a support frame/basket disposed on each arm and located thereon to receive forced air from the discharge orifice, the frame/basket configured to support thereon a face piece having an attached drinking tube;

(d) a nipple disposed on each riser tube proximate each support arm and operative to receive forced air from the riser on which the nipple is disposed and configured for connection to the drinking tube for supplying forced air to the drinking tube when connected to the nipple; and, (e) a cross piece connected to the ends of the riser tubes distal the manifold.

6. A forced air dryer for gas masks of the type having a drinking tube therewith comprising:

(a) a blower housing and an air discharge manifold connected to the blower housing and operable to receive forced air therefrom;

(b) a plurality of tubular risers removably attached, each at an end thereof, to the manifold, each of the risers operative to receive therein forced air from the manifold;

(c) a plurality of tubular gas mask support arms spaced along and extending from each of the risers, each of the arms operative to receive therein forced air from one of the risers and having a discharge port thereon operable, upon placement of a gas mask thereon, to discharge forced air for drying the gas mask;

(d) a cross piece interconnecting the risers at an end distal the manifold;

(e) a plurality of nipples, each disposed on one of the risers proximate one of the support arms and receiving forced air from the risers and having surfaces formed thereon for engagement with corresponding surfaces on a canteen cap; and, (f) wherein, upon placement of a gas mask on one of the support arms, engagement of the canteen cap on one of the nipples and connection of the drinking tube from the gas mask to the cap, the engaged nipple is operative to supply forced air from one of the risers to the drinking tube.

7. The forced air dryer of claim 6, wherein each of the support arms includes a wire frame configured to conform to the interior of a gas mask for supporting the mask when same is disposed thereon.

8. The forced air dryer of claim 6, wherein each of the nipple surfaces is configured for threadedly engaging a military canteen cap.

9. The forced air dryer of claim 8, wherein the surfaces configured for threadedly engaging are configured for engaging a standard NATO military canteen cap.

10. The forced air dryer of claim 6, wherein each of the risers has a flange attached thereto and surfaces adapted for removable attachment to the manifold.

11. The dryer defined in claim 6, wherein the manifold has mounting brackets thereon adapted for wall mounting; and, the risers are each secured to a cross member including a wall mounting bracket at an end distal the manifold.

12. The forced air dryer of claim 6, wherein the support arms include a wire frame disposed thereon and configured to conform to the interior of the gas mask; and, the discharge port is located to direct forced air through the wire frame.

13. The forced air dryer of claim 12, wherein the support arms have one of a square shape and a rectangular shape transverse sectional configuration with an upper side thereof disposed horizontally; and, the wire frame is attached to the upper side of the support arms.

14. The forced air dryer of claim 6, wherein the risers are formed of metal material and the nipples are formed of plastic material.

15. The forced air dryer of claim 6, wherein the nipples are formed of polyoxymethylene (POM) material.

16. The dryer of claim 6 further comprising mount/support brackets releasably attached to the manifold.

* * * * *